United States Patent [19]

Sorenson

[11] 4,352,965

[45] Oct. 5, 1982

[54] TOGGLE SWITCH ASSEMBLY

[75] Inventor: Richard W. Sorenson, Avon, Conn.

[73] Assignee: Carlingswitch, Inc., West Hartford, Conn.

[21] Appl. No.: 191,686

[22] Filed: Sep. 29, 1980

[51] Int. Cl.[3] ..... H01H 3/00; H01H 13/00; H01H 19/00

[52] U.S. Cl. ..... 200/6 R; 200/18; 200/339

[58] Field of Search ..... 200/6 R, 6 A, 6 B, 6 BA, 200/6 C, 17, 16 R, 16 C, 16 D, 16 F, 153 G, 153 K, 315, 329, 330, 335, 339

[56] References Cited

U.S. PATENT DOCUMENTS

| | | | |
|---|---|---|---|
| 3,333,067 | 7/1967 | Du Rocher et al. | 200/6 R |
| 3,524,952 | 8/1970 | Anderson et al. | 200/6 BA |
| 3,641,291 | 2/1972 | Carling | 200/339 X |
| 4,250,369 | 2/1981 | Larkin et al. | 200/339 |

*Primary Examiner*—James R. Scott

*Attorney, Agent, or Firm*—McCormick, Paulding & Huber

[57] ABSTRACT

Two or more metal toggles, such as a bat or paddle can be alternatively assembled with a plastic actuator in an otherwise conventional toggle switch so that the bat type toggle can be made as a body of revolution whereas the paddle type toggle is made with non-circular projections on its shank portion which are oriented with respect to the broad dimension of the paddle in order that either the paddle or the bat toggle can be assembled with the same plastic actuator part of the toggle switch assembly. Both types of toggles can be conveniently assembled by inserting the shank portion of either toggle in the opening provided for this purpose in the actuator, and each toggle is adapted to be securely held in the actuator in spite of the difference in the geometry between these toggles.

10 Claims, 6 Drawing Figures

TOGGLE SWITCH ASSEMBLY

This invention relates generally to toggle switches and deals more particularly with a unique toggle switch assembly which will permit a supplier to stock a single subassembly consisting of the switch case, cover and internal components, and which subassembly can be conveniently assembled with any one of several different style toggles as required.

SUMMARY OF INVENTION

In accomplishing the foregoing advantage a typical toggle switch assembly in accordance with the present invention preferably includes as elements of the subassembly a housing which may include a case and a cover for the case, an upwardly opening bushing fitted to the cover, fixed contacts carried in the lower portion of the case, a movable contact element for selectively bridging certain of these fixed contacts, a plastic actuator pivotally mounted in the housing preferably by means of projections defined on opposite sides of the actuator such that the actuator is adapted for pivotal movement in aligned openings provided for this purpose in the side walls of the switch case. One or more spring biased plungers are mounted in downwardly open recesses in the actuator for engaging and moving one or more movable contact elements in response to pivotal movement of the actuator.

At least two different style toggles are provided for selective assembly with the actuator, and more particularly, one of these toggles includes a paddle shaped portion projecting outwardly of the housing through the bushing, which paddle must be oriented in a particular angular position. This paddle shaped toggle has a shank portion adapted to be received in a toggle opening defined generally between the opposed projections which pivotally support the actuator in the switch case, and said shank portion has at least one projecting edge in its circular periphery such that an interference fit can be provided between this shank portion of the toggle and the actuator opening in which it is received. In order to orient the paddle shaped projecting portion of the toggle in a predetermined position with respect to the switch case subassembly the shank portion includes a non-circular portion of reduced cross sectional size which is adapted to be received in a complementary shaped portion of the toggle opening in the actuator. This geometry prevents rotation of the paddle shaped toggle in the actuator after assembly. A bat shaped toggle, comprising a body of revolution, is also adapted to be received in the same actuator opening as a result of the fact that the shank portion of the bat type toggle has a portion corresponding to that of the non-circular portion of the paddle shaped toggle which will nevertheless fit into the non-circular portion of the actuator opening, and such that this bat shaped toggle shank portion is nevertheless securely held in the actuator once it has been assembled therewith.

The chief aim of the present invention is to provide an improved switch assembly such that a distributor or supplier of switches can stock a single subassembly, which subassembly can be used with two or more different style toggles so as to avoid the necessity for stocking complete switch assemblies in order to meet the orders for any number of substantially similar toggle switches having differing external toggle geometries, such as the bat type or paddle type for example.

DETAILED DESCRIPTION

Figure 1:
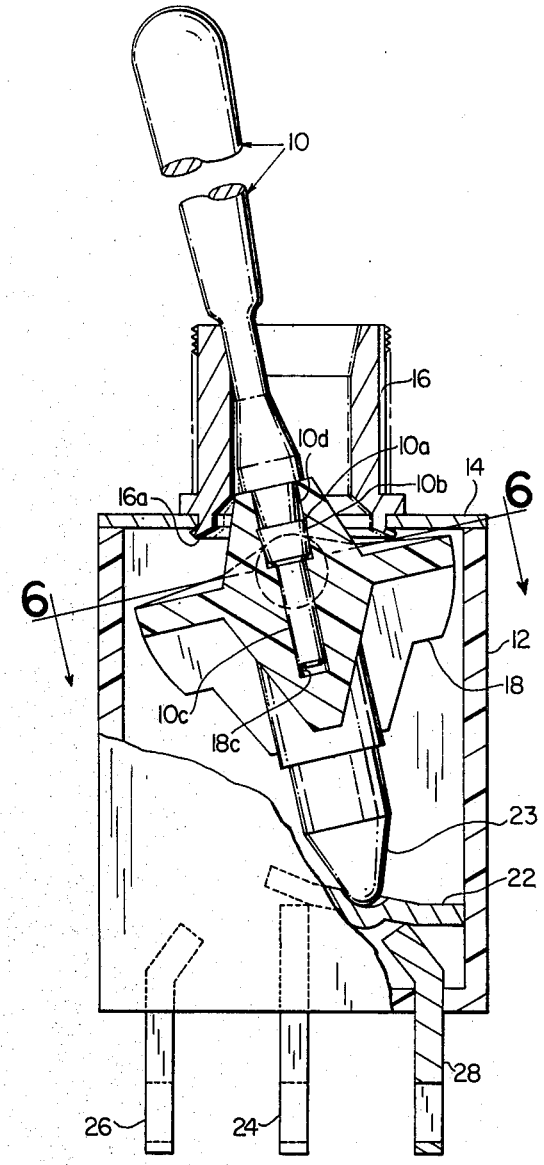
FIG. 1 is an elevational view partly in vertical section illustrating a toggle switch subassembly of the present invention assembled with a bat shaped toggle also constructed in accordance with the present invention.
Figure 2:
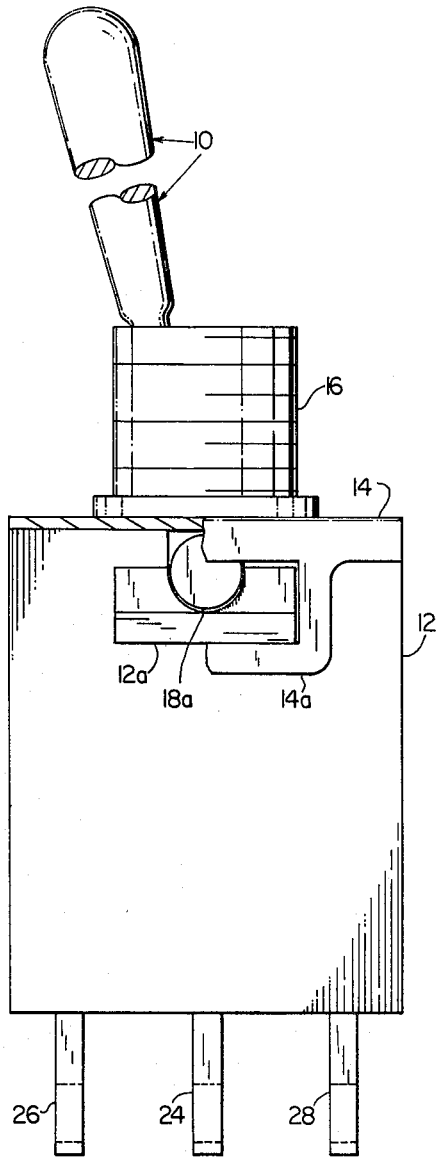
FIG. 2 is an elevational view of the toggle switch assembly of FIG. 1 with portions of the switch housing cover broken away.
Figure 3:
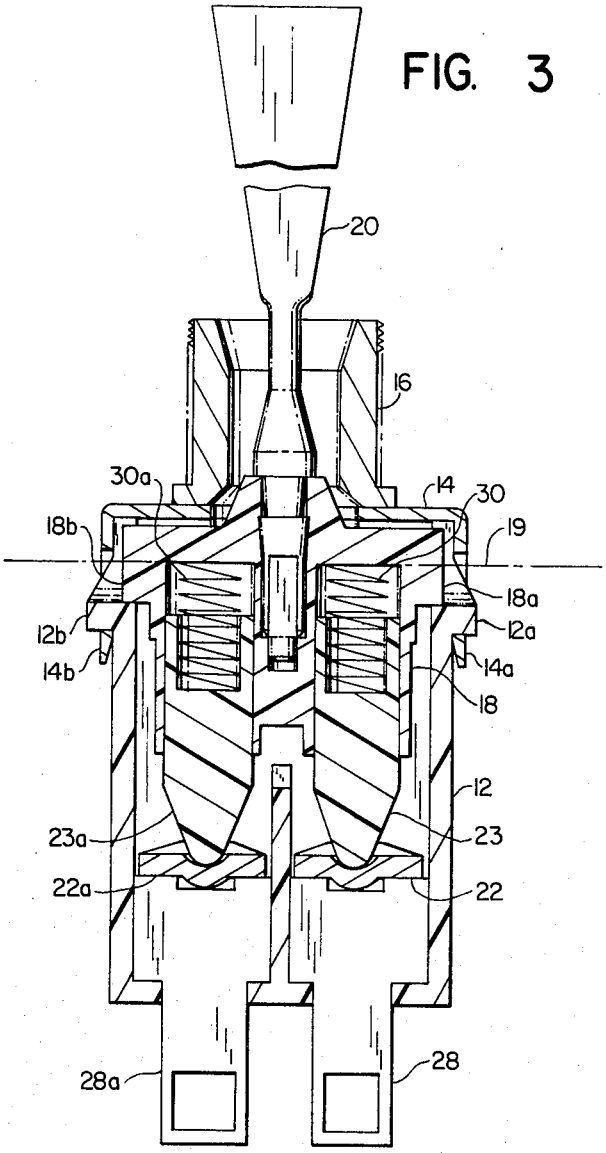
FIG. 3 is a sectional view through a toggle switch subassembly similar to that of FIG. 1 but is oriented at 90 degrees with respect to the sectional view of FIG. 1, and also illustrating the switch subassembly having a paddle shaped toggle assembled therewith.

FIG. 1 shows a toggle switch assembly including a bat style toggle 10 assembled with a switch subassembly comprising a housing in the form of a plastic case 12, a metal cover for the case indicated generally at 14, and an upwardly open bushing 16. The housing is itself of conventional construction, and as illustrated in FIG. 2 the cover 14 may include downturned end portions **14*a* and 14*b*. The bushing 16 is staked or otherwise secured to an opening in the cover 14 as best shown in FIG. 16*a*. FIG. 3 illustrates the geometry of the plastic switch case 12 wherein projecting portions 12*a*, 12*b* are adapted to be received in openings defined by the ears 14*a*, 14*b* respectively in order to hold the cover 14 and the case 12 in assembled relationship. It should be noted at this juncture that the switch case subassembly, including the housing described above as illustrated in FIGS. 1, 2 and 3, provides a standardized subassembly of components including a standardized configuration for the actuator 18 such that this subassembly, comprising at least said actuator 18, boss 16, cover 14 and case 12, can be conveniently assembled with the bat style toggle 10 illustrated in FIGS. 1 and 2 or the paddle style toggle 20 illustrated in FIGS. 3 and 4** or with other style toggles (not shown).

Turning next to a more detailed description of the internal parts of the switch subassembly including the actuator 18, FIG. 3 shows the actuator 18 as comprising a molded plastic part which is pivotally mounted in the housing for limited movement about a lateral axis 19 defined by opposed projecting portions **18*a* and 18*b* of the actuator 18, which projecting portions are received in sockets defined for this purpose in the side walls of the plastic switch case 12 as best shown in FIGS. 2 and 3. The actuator also includes at least one downwardly open plunger recess or opening for slidably receiving a plunger 23 in order that the lower end or tip of plunger 23 can be maintained in continuous contact with a movable metal contact element 22, which latter element is adapted to move from the position shown for it in FIG. 1 to an alternative position wherein the element 22 is bridging the space between center fixed contact 24 and fixed contact 26, rather than bridging the center contact 24 and contact 28 as shown in this view. A compression spring 30 is provided between the upper end of plunger 23 and the inside of the plunger 23 and the inside of the plunger opening as best shown in FIG. 3 and it is a feature of the present invention that more than one such plunger 20 can be provided in order to adapt the present invention to a double pole switch arrangement as suggested in FIG. 3. Thus, in FIG. 3, plunger 23***a* is adapted to continuously contact movable contact 22*a* in order to move in synchronism with movable contact element 22 so as to provide selective communication between the center contact 24*a* (not shown) and the contact 28*a* (shown in FIG. 3) or a third fixed contact 26*a* (not shown). Spring 30*a* is identical to spring 30 in that it urges plunger 23*a* into position for engaging movable element 22*a* as described above.

Still with reference to the configuration of the actuator 18, and in order to provide for the advantages of the present invention plastic actuator 18 has an upwardly open toggle opening for receiving the inner shank portion of either the bat shaped toggle 10 or the paddle shaped toggle 20. Aside from the external configuration of these toggles being different from one another, the inner shank portions of said toggles 10, 20 have certain similarities which will now be discussed. Turning first to a comparison of FIGS. 1 and 4, toggle 10 comprises a body of revolution in that its metal shank portion is adapted to be received in the toggle opening of actuator 18, and a stepped portion 10*a* is provided, of circular cross section, to permit this toggle to be secured to the plastic actuator by reason of an interference fit between the generally cylindrical portion of the toggle opening and this stepped portion 10*a* of the toggle shank. More particularly, this stepped portion comprises a peripheral edge 10*a* determined by an outwardly facing annular flange and the larger diameter end of an inwardly tapered conical surface of revolution 10*b* which taper is adapted to facilitate the assembly of the toggle 10 with the actuator 18 in order that the annular outwardly facing flange may serve to inhibit dissassembly of these parts after they have been once joined together.

Figure 6:
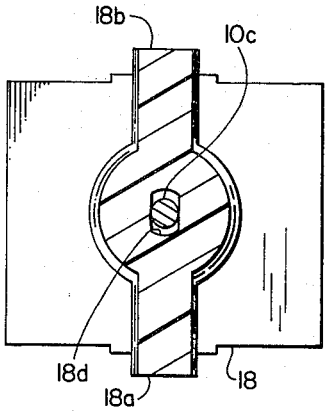
FIG. 6 is a horizontal sectional view taken generally on the line 6—6 of FIG. 1 with the switch case being omitted for clarity, and so that FIG. 6 can be readily compared with FIG. 5.

The inner end portion of the metal shank for toggle 10 comprises a cylindrical shape, best illustrated in FIG. 6 at 10*c*, and prior to leaving the description of the bat shaped toggle 10 it should perhaps be noted that the outwardly facing annular flange which defines the peripheral edge 10*a* has an inside boundary which defines the smaller diameter end of a secondary tapered conical surface of revolution 10*b* the larger diameter of which secondary surface is substantially identical in diameter to that of the cylindrical outer portion of the toggle opening itself. This geometry serves to secure the toggle 10 adjacent the upper end of the cylindrical opening of the actuator 18. The lower end of the shank portion of the toggle 10 is similarly secured in a pilot opening 18*c* having the same diameter as the lower end of shank portion 10*c*. Intermediate this lower or inner portion 18*c* of the toggle opening in the actuator 18 and the outer or upper portion thereof described above, the toggle opening has a non-circular cross sectional configuration best shown at 18*d* in FIG. 6 which non-circular configuration is generally rectangular, and the smaller dimension of the rectangle has substantially the same linear dimension as the diameter of the inner end 10*c* of shank portion for toggle 10. The longer dimension of the generally rectangular opening corresponds closely to the diameter of the toggle opening as discussed above with reference to the interference fit for stepped portion 10*a*.

Thus, the toggle opening in actuator 18 has an inner pilot opening portion of the same diameter as that of the tip of shank portion 10*c* of toggle 10. The outer portion of the opening in actuator 18 provides an interference fit with the stepped portion 10*a* of toggle 10, and an intermediate portion between these inner and outer toggle opening portions defines opposed parallel side walls 18*b* and 18*f*, best shown in FIG. 5. These side walls 18*b* and 18*f* of the non-circular opening portion are spaced from one another by the diameter of the shank portion 10*c*. As shown in FIG. 5 this non-circular configuration does serve a purpose, but only upon insertion of the paddle type toggle 20 illustrated in FIGS. 3 and 4. With the toggle 10 inserted in the actuator 18 this non-circular portion of the toggle opening in the actuator 18 serves no purpose. It is one very important feature of the present invention is that this non-circular portion of the toggle opening in actuator 18 does not interfere with the secure assembly of the bat type toggle 10 as described above.

Figure 4:
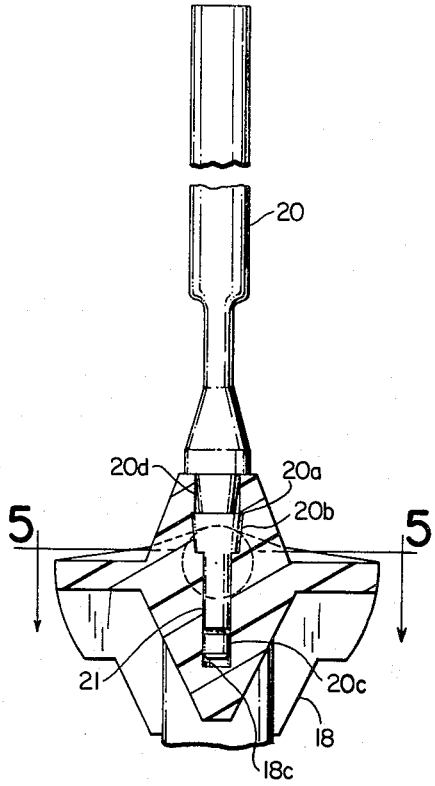
FIG. 4 is an elevational view of the paddle shaped toggle of FIG. 3 assembled with its associated actuator in the switch subassembly of FIG. 3, this view being taken from the same vantage point as that of FIG. 1 which illustrates the bat shaped toggle.
Figure 5:
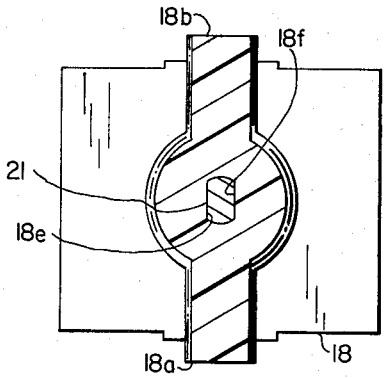
FIG. 5 is a horizontal sectional view taken generally on the line 5—5 of FIG. 4.

Turning next to a description of the paddle type toggle illustrated in FIGS. 3 and 4, and more particularly to its unique shank portion as illustrated in these views, it will be apparent from FIG. 4 that the external contour of the shank portion in this particular view corresponds closely to that of the body of revolution shape for the shank portion depicted for the toggle 10 in FIG. 1. More particularly, the peripheral edge 20*a* corresponds to the edge 10*a* described above for forming the interference with the toggle opening in the actuator 18. Furthermore, the inwardly tapered portion 20*b* facilitates entry of the shank portion of the toggle element 20 into this toggle opening for actuator 18 as described above with reference to the conical surface of revolution 10*b* described above. The innermost end portion 20*c* of the toggle shank portion shown in FIG. 4 has the same circular cross sectional size and shape as the portion 10*c* of toggle 10 in FIG. 1, but an intermediate portion of the shank portion for toggle 20 is of non-circular cross section and has a generally rectangular shape as depicted at 21 in FIG. 4. The sectional view of FIG. 5 illustrates the shape more precisely, and it will be apparent from the remarks made previously with reference to FIGS. 5 and 6 and to the foregoing remarks made with reference to the shape of the openings in actuator 18 that this non-circular portion has dimensions complementing the generally rectangular dimension of the toggle opening itself (18*e*, 18*f*).

Still with reference to the shank portion of the paddle shaped toggle 20 illustrated in FIGS. 3 and 4, a secondary tapered conical surface of revolution is defined outwardly of the annular flange defining the peripheral edge 20*a*, and more particularly of the inside boundary of this flange which defines the smaller diameter of this secondary tapered conical surface 20*d*. This surface 20*d* is identical to that described above with reference to the bat shaped toggle 10, and more particularly to the surface 10*d* thereof. The larger diameter end of this secondary tapered conical surface 20*d* fits snugly in the outer end portion of the opening in the actuator 18 even as the inner end 20*c* of the toggle 20 fits snugly in the inner or pilot opening end of the actuator's toggle opening.

I claim:

1. A toggle switch assembly comprising a housing which includes at least a case, a cover for the case, and an upwardly open bushing fitted to the cover; fixed contacts carried by the case, a movable contact element for selectively bridging certain of these fixed contacts, a plastic actuator pivotally mounted in the housing for movement about a lateral axis, at least one spring biased plunger mounted in a plunger opening of said actuator for engaging and moving said contact element in response to pivotal movement of said actuator, at least two toggles for selective assembly with said actuator, one of said toggles including a paddle shaped portion adapted to project outwardly of said housing and through said bushing to facilitate pivotal movement of said actuator, said paddle shaped toggle having a metal shank portion adapted to be received in a toggle opening defined by said actuator on assembly therewith, said shank portion having a stepped portion of circular cross section providing a permanent interference fit with a cylindrical outer portion of said toggle opening, and said shank portion having a non-circular inner cross sectional portion of reduced section size adapted to be received in a complementary shaped portion of said toggle opening to prevent rotation of said toggle in said actuator after assembly.

2. The toggle switch assembly of claim 1 wherein said non-circular portion of said toggle shank portion comprises a generally rectangular cross section with its longer dimension corresponding approximately to the diameter of said cylindrical outer portion of said toggle opening and its shorter dimension corresponding approximately to the spacing between opposed side walls defined by said complementary portion of said toggle opening.

3. The toggle switch assembly of claim 1 wherein another of said at least two toggles comprises a body of revolution.

4. The toggle switch assembly of claim 2 wherein another of said at least two toggles comprises a body of revolution with a bat shaped portion adapted to project outwardly of said housing and through said bushing, said bat shaped toggle having a metal shank portion adapted to be received in said toggle opening, said last mentioned shank portion having a stepped portion of identical cross section to that of said paddle toggle shank portion and having a reduced diameter circular cross sectional inner portion adapted to fit between said opposed side walls of said toggle opening of said actuator upon assembly therewith.

5. The toggle switch assembly of claim 1 wherein said actuator has oppositely projecting boss portions defining said lateral axis, said boss portions being rotatably received in correspondingly shaped openings defined in the case.

6. The toggle switch assembly of claim 5 wherein said toggle opening of said actuator is defined midway between said boss portions and is oriented perpendicular to said lateral axis, two such plunger openings being provided in said actuator, each said plunger opening located between said toggle opening and one of said opposed boss portions.

7. The toggle switch assembly of claim 1 wherein said stepped portion of said metal shank portion of said paddle shaped toggle is more particularly defined at the peripheral edge of an outwardly facing annular flange which edge also defines the larger diameter end of an inwardly tapered conical surface of revolution, said tapered surface facilitating the assembly of said toggle with said actuator and the annular flange serving to inhibit disassembly thereof.

8. The toggle switch assembly of claim 7 wherein said outwardly facing annular flange of said metal shank portion has an inside boundary which defines the smaller diameter end of a secondary tapered conical surface of revolution the larger diameter of the secondary surface being substantially identical to the diameter of said cylindrical outer portion of said toggle opening in said actuator.

9. The toggle assembly of claim 8 wherein an inner portion of said toggle opening is provided in said actuator said complementary shaped non-circular portion of said toggle opening being provided between said inner portion and said outer cylindrical portion, said inner portion defining a pilot opening, a cylindrical tip on said toggle shank portion snugly received in said pilot opening.

10. The toggle assembly of claim 4 wherein an inner portion of said toggle opening is provided in said actuator said complementary shaped non-circular portion of said toggle opening being provided between said inner portion and said outer cylindrical portion, said inner portion defining a pilot opening, a cylindrical tip on said toggle shank portion snugly received in said pilot opening.

* * * * *